United States Patent [19]

Bruns et al.

[11] Patent Number: 5,005,995

[45] Date of Patent: Apr. 9, 1991

[54] METHOD OF AUTOMATICALLY IDENTIFYING A PRINT WHEEL

[75] Inventors: Ewald Bruns; Rolf Bruns, both of Westerstede, Fed. Rep. of Germany

[73] Assignee: AEG Olympia Office GmbH, Wilhelmshaven, Fed. Rep. of Germany

[21] Appl. No.: 516,132

[22] Filed: Apr. 27, 1990

[30] Foreign Application Priority Data

Apr. 29, 1989 [DE] Fed. Rep. of Germany ..... 3914256

[51] Int. Cl.[5] ..... B41J 1/30; B41J 7/76

[52] U.S. Cl. ..... 400/144.2; 400/154.4

[58] Field of Search ..... 400/144.2, 154.4, 154.1, 400/162.3, 144.3; 101/93.17, 93.19, 93.26

[56] References Cited

U.S. PATENT DOCUMENTS

| | | | |
|---|---|---|---|
| 3,498,439 | 3/1970 | Willcox . | |
| 3,651,916 | 3/1972 | Becghi | 400/154.4 |
| 3,731,780 | 5/1973 | Wolf et al. | 400/154.4 |
| 4,074,798 | 2/1978 | Berger . | |
| 4,118,129 | 10/1978 | Grundherr | 400/154.4 |
| 4,293,233 | 10/1981 | Hoffman . | |
| 4,541,746 | 4/1985 | Bobart et al. | 400/144.2 |
| 4,605,324 | 8/1986 | Musso | 400/144.2 |
| 4,640,634 | 2/1987 | Ozwa | 400/144.2 |
| 4,747,708 | 4/1988 | Musso | 400/144.2 |
| 4,775,253 | 10/1988 | Ozawa et al. | 400/144.2 |
| 4,776,713 | 10/1988 | Takahashi et al. | 400/144.2 |
| 4,821,644 | 4/1989 | Gawler | 400/154.2 |
| 4,865,475 | 9/1989 | Takahashi | 400/144.2 |

FOREIGN PATENT DOCUMENTS 2834662 3/1979 Fed. Rep. of Germany .

*Primary Examiner*—Eugene H. Eickholt
*Attorney, Agent, or Firm*—Spencer & Frank

[57] ABSTRACT

A print wheel and a method for automatically identifying the print wheel after insertion into a printer or a typewriter which makes it possible to automatically adapt certain printing parameters, such as imprint strength, pitch, ribbon advance step, without the operator having to make separate settings when changing print wheels. The method and print wheel make it possible to identify the type of print wheel in a simple manner in that the angle between a stop element and a coupling element of a pin/slot connection on the hub of the print wheel is given a different size in dependence on the set of type faces provided on the spokes of the print wheel. The blockage of the drive motor during a search run causes control signals to be generated in a control circuit from which the control circuit then calculates the size of the angle by counting the steps required until the zero position of the print wheel is reached and determines identification data from it which are stored as digital signals in a digital memory. The sequence of the printer functions, such as movement of the type carrier carriage in the line direction, control of the type imprinting strength, is controlled by the control circuit in view of the identifying data stored in the digital memory.

12 Claims, 4 Drawing Sheets

METHOD OF AUTOMATICALLY IDENTIFYING A PRINT WHEEL

CROSS-REFERENCE TO RELATED APPLICATION

This application claims the priority of Federal Republic of Germany Application No. P 39 14 256.6 filed Apr. 29th, 1989, which is incorporated herein by reference.

BACKGROUND OF THE INVENTION

The present invention relates to a print wheel and a method of automatically identifying various print wheels in a printing mechanism of a typewriter or other office machine of similar construction. In particular, the present invention relates to a method of identifying an improved print wheel of the type comprising a hub having a centrally disposed bearing bore, and a plurality of spokes extending radially from the hub with each spoke carrying a type face at its outer end, and with the hub having one element of a pin/slot connection from coupling the hub in a form-locking manner with a print wheel receptacle, which is driven by a drive motor, of a print mechanism to fix a defined angle between the drive motor and a zero position of the print wheel.

Presently employed printers, such as widely used serial printers, use a large number of print wheels bearing different type faces corresponding to various languages and fonts, and a considerable number of different print wheels exist for various printing purposes. Although these print wheels contain different type faces, they usually have the same overall structure so that they are easily interchangeable for use in different printers. These print wheels may also be rotatably arranged within cartridges which can then be interchangeably inserted for a specific printing process into a serially operating printer.

Although both the print wheels and their associated cartridges have the same structure, printing conditions differ depending on the type or consistency of a print wheel, so that, when print wheels are to be exchanged, operating conditions on the side of the printer itself must be changed to correspond to the exchange of print wheels. For example, the imprint strength, pitch, ribbon advance and/or other parameters of the printing mechanism may need adjustment when changing print wheels to obtain satisfactory printing.

U.S. Pat. No. 4,018,639 to Staples discloses a printing element in the form of a print wheel which is not provided with a code or a display that is machine readable. Thus, a printing machine receiving a printing element according to this patent cannot automatically cause a printer to change operating conditions when new printing elements are encountered. Instead, the Staples print elements require an operator of the machine to identify information on the printing element and to appropriately set parameters of the printer for each printing element so identified.

Another known printing system is disclosed in U.S. Pat. No. 3,498,439 to Willcox and employs a coded disc in connection with type elements to automatically set the printer to operate in a certain manner. However, the type element does not bear a code.

DE-OS 2,834,662 discloses a print wheel including a coded region scannable by a sensor that is in communication with a control circuit. The sensor reads the coded region and the circuit controls the printing system according to the coded region read by the sensor. The coded region includes a series of open and closed digit positions which constitute a binary code. The first and second digits are always open providing an unequivocal starting or rest position. The third digit is coded to indicate whether this is a regular or a special printing element. The fourth, fifth and sixth digits following the third digit are coded to provide information for controlling the spacing or pitch between type faces. The seventh digit is coded to indicate the number of type faces and the eights and ninth digits to indicate the striking force of the hammer. The drawback of this solution is the relatively high manufacturing costs involved in the application of the extensive coded region on individual print wheels and for the additional sensor device.

SUMMARY OF THE INVENTION

It is an object of the present invention to provide a method of automatically identifying print wheels of the above type in printing mechanisms of typewriters or office machines of similar construction employing print wheels without requiring separately applied coded regions which make the manufacture of the print wheel more expensive.

The above object is initially achieved according to the present invention by providing a print wheel of the type comprising a hub having a centrally disposed bearing bore, and a plurality of spokes extending radially from the hub with each spoke carrying a type face at its outer end, and with the hub having one element of a pin/slot connection for coupling the hub in a form-locking manner with a print wheel receptacle, which is driven by a drive motor, of a print mechanism to fix a defined angle between the drive motor and a zero position of the print wheel; and wherein an abutment is disposed on the hub for engaging a selectively moveable blocking member disposed on the printing mechanism to stop rotation of the print wheel during an initial rotary search movement in a printing mechanism to enable engagement of the pin/slot connection, and the abutment forms an angle in a direction of rotation with the element of the pin/slot connection on the zero position of the print wheel, with the angle consitituting said identifying feature and being different for each set of type faces.

The above object is achieved according to the method of the invention by:

inserting a print wheel according to the invention in the receptacle of the printing mechanism and rotating the print wheel in a first direction with the blocking member in a position to engage the stopping element on the hub of the print wheel to cause engagement of the pin/slot connection; detecting blockage of the drive motor; rotating the print wheel in the opposite direction after detection of drive motor blockage; determining the size of said angle by counting the number of steps of movement of the print wheel until the zero position of the print wheel is reached; and using the determined size of the angle to produce identification data for the print wheel which are stored as digital signals in a digital memory, to enable the sequence of printer functions of the printing mechanism to be controlled automatically for the particular set of print type faces of the identified print wheel.

The automatic detection of inserted print wheels, according to the invention, in respective receptacles of typewriters or similar office machines is very cost effective and requires no additional expenditures for the machine since additional scanning devices are not required. Additionally, the manufacture of the print wheels, themselves, does not become more complicated or expensive.

Further advantageous features of the invention will become evident from the detailed description below with reference to the drawings.

DETAILED DESCRIPTION OF THE PREFERRED EMBODIMENTS

Figure 1:
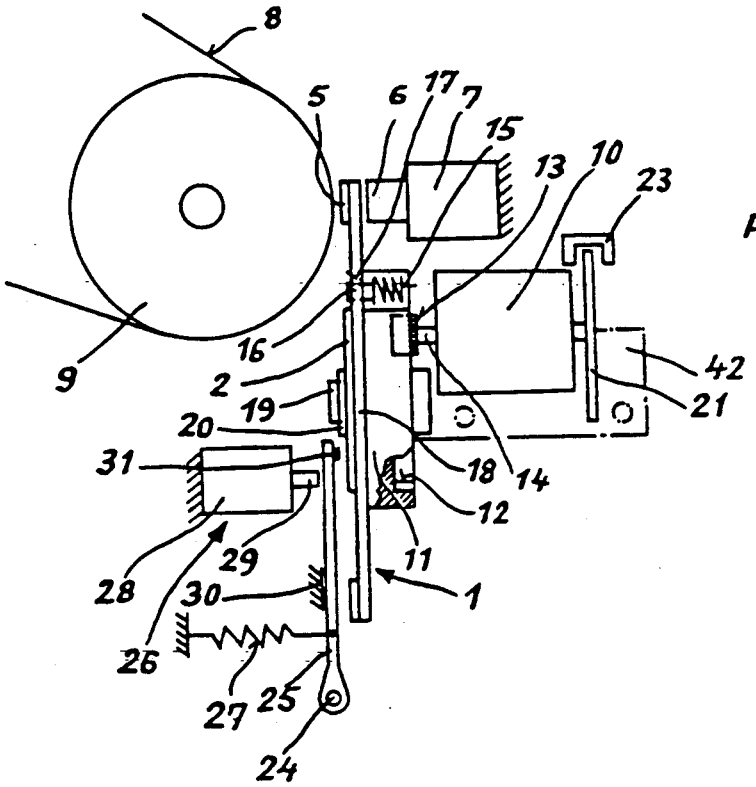
FIG. 1 is a schematic illustration of a printing mechanism including an exchangeable print wheel.

FIG. 1 shows the printing mechansim of a typewriter or office machine of similar construction including a print wheel 1 provided with a hub 2 which has a centrally disposed bearing bore 3 and from which a plurality of spokes 4 extend. The outward ends of the spokes 4 are provided with type faces 5 that can be charged with axial pressure for printing. The surface of the spokes 4 opposite the type faces are charged by a hammer 6 of the printing mechanism, which can be an armature of an electromagnet 7, to produce an imprint of the charged type faces on a record carrier 8 such as paper. Record carrier 8 is transported by a platen 9 which is driven by a stepping motor (not shown).

Figure 2:
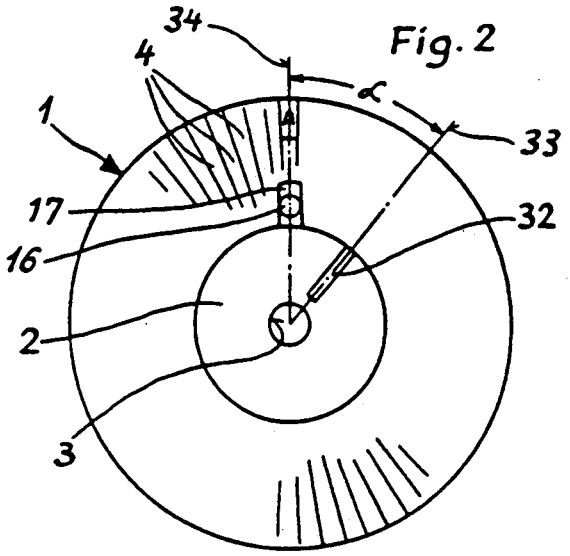
FIG. 2 is a schematic front view of a first embodiment of a print wheel according to the invention.

Hub 2 can be coupled in a form-locking manner with a print wheel receptacle 11 by way of a pin/slot connection. Print wheel receptacle 11 is driven by motor 10 and serves to fix a defined angle between drive motor 10 and print wheel 1. Print wheel receptacle 11 has internal teeth 12 which are in engagement with a drive pinion 13 of the drive shaft 14 of drive motor 10. The pin/slot connection includes a pin 16 extending from print wheel receptacle 11 and which is tensioned in the axial direction by a spring 15 to form-lockingly engage with correspondingly configured slot 17 on print wheel 1 when slot 17 is lined up with pin 16. Moreover, print wheel 1 is disposed, via its central bearing bore 3, on a bearing pin 19 arranged centrally in print wheel receptacle 11 and is retained in a known manner by a fastening element 20. Slot 17 of print wheel 1 comprises a long hole which is arranged symmetrically to the geometric radial line indicating the zero position of print wheel 1. As shown in FIG. 2, the zero position of the print wheel is at the spoke bearing the letter "A".

Figure 3:
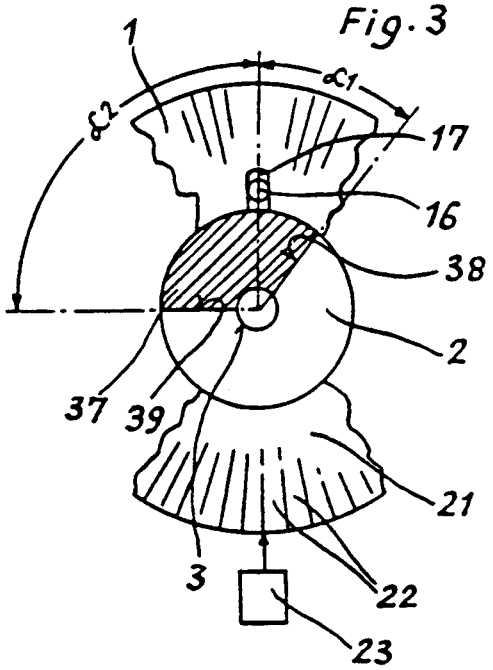
FIG. 3 shows an overlay of a partial front view of a second embodiment of a print wheel according to the invention with a partial view of a clocking disc to schematically illustrate the relationship therebetween.

The drive motor 10, shown in FIG. 1, includes a d.c. motor which has, on its side opposite drive pinion 13, a clocking disc 21 disposed on drive shaft 14 so as to act as a clock pulse generator. On its outer periphery, this clocking disc is provided with markings 22 and a scanning device 23 reads these markings in a known manner so as to generate clock pulses for a control circuit. Markings 22 may be marking strips or slots which are scanned, for example, optically by scanning device 23 as shown in FIG. 3. Scanning device 23 and the markings may of course also be configured differently.

In order to ensure reliable engagement of the spring-tensioned pin 16 in slot 17 of print wheel 1 is after an exchange of print wheels, print wheel 1 is stopped during the rotary search movement by a blocking member which cooperates with a stopping element disposed on hub 2. Only after pin 16 has engaged slot 17 is the blocking member moved out of engagement with the stopping element at hub 2. The blocking member comprises a blocking lever 25 which can be pivoted about an axis 24 to block print wheel 1. A reset spring 27 is attached to blocking lever 25 above axis 24 to hold the lever in a rest position away from the print wheel. In its rest position, blocking lever 25 lies against a fixed abutment 30. Blocking lever 25 is pivoted against the force of reset spring 27 from the rest position into the blocking position by a drive member 26. Drive member 26 includes an electromagnet 28 which has a movable armature 29 which pivots the lever 25 toward the print wheel.

The free end of blocking lever 25 is provided with a blocking tab 31 which engages in a form-locking manner with a stopping element, such as detent recess 32, in hub 2 when pivoted by armature 29. The stopping element on hub 2 may also be a projecting stop. The angle formed on the hub between a geometric radial line 33 through detent recess 32 and a geometric radial line 34 through slot 17 is marked $\alpha$.

As a result of this structure, the present invention can provide a simple method for automatically identifying a print wheel 1 in the printing mechanism of a typewriter or office machine of similar construction. According to the invention, the angle $\alpha$ between the stopping element (e.g., recess 32) and the coupling element (slot 17) of the pin/slot connection of print wheel 1 is of differing sizes (degrees) depending on the set of type faces 5 provided on spokes 4. For example, the angle $\alpha$ would be different for a German keyboard than for an American keyboard.

The blocking of drive motor 10 by the blocking member during a search run actuates control signals in a control circuit 35 (FIG. 4) and by using those signals the size of the angle is calculated. This is accomplished by counting the number of markings 22 required to advance the print wheel 1 from the blocking position to the zero position. Data identifying the particular print wheel is determined therefrom by comparing digital signals stored in a digital memory 36 which represent known values of angle sizes and the print wheel associated therewith. The sequences of printing functions, such as movement of print wheel 1 in the line direction, contact pressure of type faces 5 during printing, ribbon advance steps, etc., are controlled by control circuit 35 in view of the identification data stored in digital memory 36.

If hub 2 has only one detent recess 32 or other stopping element for abutting the blocking member 25/31, only one possible piece of information is available for identifying the type of print wheel. As shown in FIG. 3, the information content can be expanded in that the distance between side edges of detent recess 32 and angular orientation of the side edges can be changed. Thus, according to the embodiment of FIG. 3, the stopping element includes a recess 37 having side edges 38 and 39 radially extending from bearing bore 3 and which serve as abutments for the blocking member. One side edge 38 can be brought into the abutting position with the blocking member during rotation of print wheel 1 to the left and the other side edge 39 during a rotation of print wheel 1 to the right so as to determine the size of the angle and thus, the identifying data. Recess 37 is disposed on hub 2 such that slot 17 or the zero position of print wheel 1 is positioned within its possible rotation range and lies between side edges 38 and 39.

The methods of scanning such an identity code, according to the invention, will now be described for a printing system using a stepping motor and for a system employing a d.c. current motor for driving print wheel 1. In both cases it can be assumed that a sensor is provided to detect the zero position.

Figure 4:
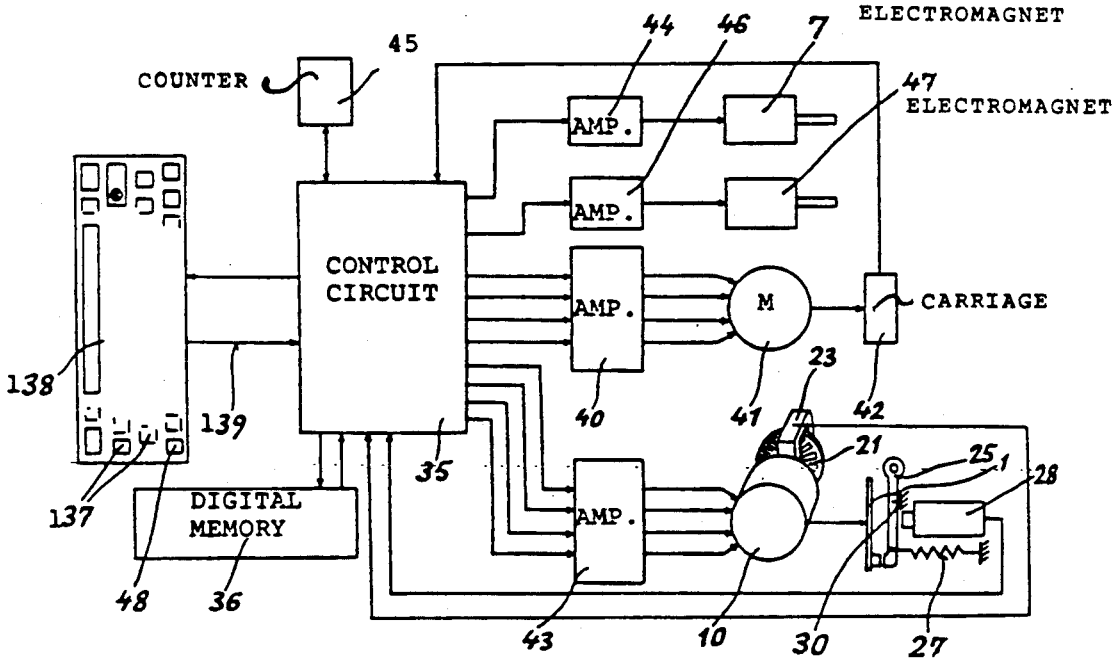
FIG. 4 is a block circuit diagram of a circuit arrangement for various driving members of a printing system, according to the invention.

FIG. 4 is a block circuit diagram for a circuit arrangement for various drives in an office printing machine. If a key 137 of a keyboard 138 is actuated, control instructions are given via a data and instruction input 139 to a control circuit 35 which is, for example, a microprocessor. The control instructions include a sequence of signal combinations, each being composed of four signal combinations which are switched through by means of control circuit 35 to the windings of the drive motor 10 so as to set the rotary position of print wheel 1. Additionally, control circuit 35 is connected with a digital memory 36 in which are stored operating programs for generating setting routines during start-up of the printing machine which set the rotary position of the print wheel and other initializing parameters.

By way of data and instruction input 139, information coming from keyboard 138 for data to be printed on record carrier 8 and for functions to be performed by the machine are conducted to control circuit 35. These functional instructions include, among others, information for the step-wise advance of a type carrier carriage 42, with carriage 42 being driven by a drive motor 41 that receives appropriate control instructions via an amplifier 40 from control circuit 35.

Electromagnet 7 and hammer 6, as well as a drive magnet 47 for advancing the ribbon, also receive the appropriate control signals via amplifiers 44, 46 from control circuit 35.

When the machine is switched on by way of a switch 48 in keyboard 138, control circuit 35 actuates motor 41 in accordance with control instructions received from amplifier 40 or an actuating member to move type carrier carriage 41 leftward to the absolute left margin of a line where the blocking member is disposed. Then, control circuit 35 calls up an operating program for generating setting routines from digital memory 36, and sends the corresponding control instructions to an electromagnet 28 of the blocking member and to drive motor 10.

In accordance with these instructions, electromagnet 28 is excited moving its armature 29 to force blocking lever 25 from its rest position to the blocking position where it is in contact with the frontal face of hub 2. By way of drive motor 10, print wheel 1 is rotated counterclockwise to bring blocking tab 31 of blocking lever 25 into engagement with a detent recess 32 or 37 disposed on hub 2 of print wheel 1. This causes the rotation of print wheel 1 to stop while print wheel receptacle 11 continues to be rotated until pin 16 engages with slot 17 of the blocked print wheel 1. This engagement also blocks any movement generated by drive motor 10 and causes control signals to be actuated by control circuit 35 to switch off drive motor 10. Then, electromagnet 28 is de-excited so that armature 29 is retracted and reset spring 27 brings blocking lever 25 out of engagement again with detent recess 32 and in contact with fixed abutment 30.

Print wheel 1 is then moved clockwise into the zero position shown in FIG. 2. The size of the angle formed between the blocked position of the print wheel and the zero position is measured by counting the number of markings 22 scanned by scanning device 23 required for print wheel 1 to reach the zero position. The number of counted steps or markings is retained in a counter 45 connected with control circuit 35. With the aid of the counted markings of clocking disc 21, control circuit 35 can determine the identify code associated with print wheel 1. Identification data are stored for each print wheel to be employed as digital signals in digital memory 36 and thus, this method can unequivocally identify the type of print wheel.

Printer functions actuated by keys 137 of keyboard 138, such as movement of carriage 42 in the line direction, ribbon advance control, and control of the contact pressure of the type faces during printing, are controlled by control circuit 35 in view of the identification data stored in digital memory 36. Accordingly, the machine operator need not perform any additional settings when a print wheel is exchanged for a new print wheel since the printer functions are automatically adapted to the set of type faces carried by the newly inserted print wheel.

Expansion of the information content available in FIG. 2, in which print wheel 1 has only one detent recess 32, can be realized, as shown in the embodiment of FIG. 3, by providing hub 2 with a recess 37 having side edges 38 and 39 radially extending from bearing bore 3 in an angular orientation. In this case as well, type carrier carriage 42 is moved into the absolute left margin position of a line. The excitation of electromagnet 28 and thus, the pivoting of blocking lever 25 from the rest position to the blocked position, occurs in the same manner as described above.

In this embodiment, in a first rotation direction, a first blocking of print wheel 1 and thus of drive motor 10 is effected by side edge 38 abutting against blocking tab 31 of blocking lever 25, subsequent to the engagement of spring-tensioned pin 16 in slot 17 of print wheel 1. Then, the print wheel is moved into the zero position. The number of markings 22 is again counted when print wheel 1 is moved from the first blocking position to the zero position and stored in counter 45 for determining the size of an angle $\alpha 1$ therebetween.

Next, print wheel 1 is rotated in a second rotation direction, opposite the first rotation direction until blocking tab 31 abuts against the other side edge 39 of recess 37. Thereafter, the print wheel is again rotated from this second blocked position back to the zero position, with an angle $\alpha 2$ between the zero position and the second blocked position again being determined by counting the number of markings scanned therebetween. In this way, the size of the angle and its position relative to the zero position of print wheel 1 are determined by control circuit 35, with blocking lever 25 being activated, by drive motor 10 turning to the left and to the right, thus determining a complete identity code for the print wheel. However, the code recess 37 of print wheel 1 must be placed in such a way that the zero position of print wheel 1 lies within its possible rotation range between side edges of the recess.

Figure 5:
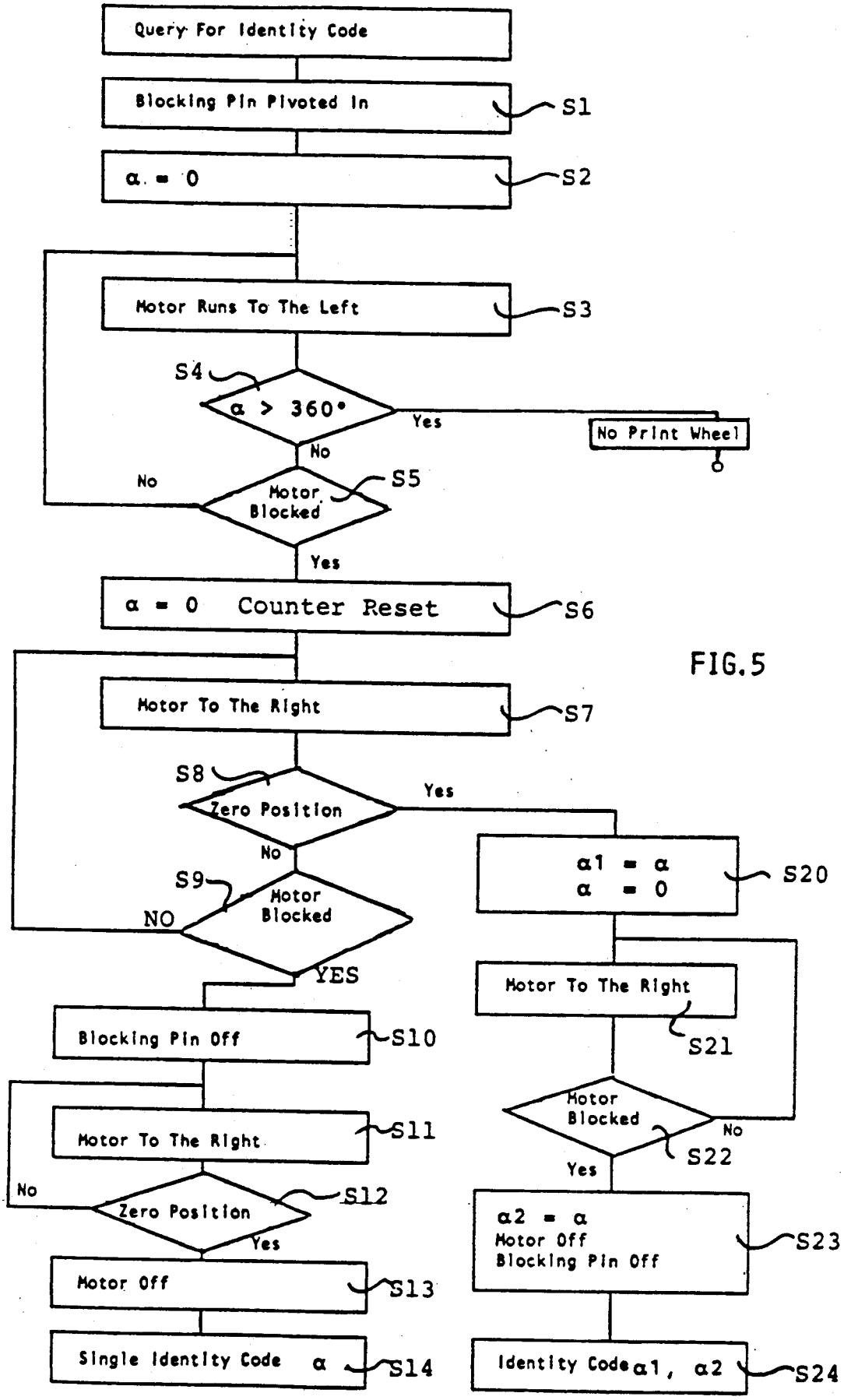
FIG. 5 is a flow chart showing the sequences of functions for identifying a print wheel according to the invention driven by a d.c. motor.

FIG. 5 is a flow chart illustrating the sequence of functions for the identification of the print wheel driven by a d.c. motor. In this example, blocking lever 25 is initially brought into the blocking position (S1) and then a counter which serves as a marker in control circuit 35 is set to $\alpha=0$ (S2). An amplifier 43 sends drive pulse signals to motor 10 and the recieved drive pulses cause the motor to generate movement to the left (S3). During this counter-clockwise movement, control device 35 continuously determines whether the angular rotation of the motor is such that angle $\alpha>360°$ (S4). If step S4 is answered in the affirmative, the absence of a print wheel is determined by the control device. If, however angle $\alpha$ is a $<360°$, a determination is made whether motor 10 is blocked (S5).

If step S5 is answered in the negative, the sequence returns to step S3 and motor 10 continues to receive drive pulse signals for rotation to the left. If step S5 determines motor 10 is blocked, the counter is reset to $\alpha=0°$ at steps S6, and motor 10 is rotated to the right (step S7). During this movement, the query of whether the zero position of print wheel 1 has been detected (e.g., by a scanning device) is made continuously (S8). If no zero position is detected, the sequence proceeds to step S9 to determine whether motor 10 is blocked. If there is no motor blockage, motor 10 continues to rotate to the right as the sequence of steps S7–S9 is repeated until such time as either a zero position of the print wheel is detected (S8) or blockage of the motor is detected.

If blockage of the motor 10 is determined (S9) before a zero position of the print wheel is detected (S8), blocking lever 25 is reset (S10) so as to release print wheel 1 and motor 10, which is form-lockingly connected to the wheel via the pin/slot connection 16, 17. After the release of the blocking lever 25, motor 10 is rotated to the right to continually drive the print wheel 1 clockwise until the sensor or scanning device determines print wheel 1 has reached its zero position as set forth in steps S11–S13. During this movement to the right, and as described above, the number markings 22 detected by the scanning device 23 is recorded in counter 45 as a measure of the angle $\alpha$ (S14). According to the invention, each print wheel having a different set of type faces also has a different angle $\alpha$.

If after beginning the rotation to the right of motor 10 in step S7, the zero position of print wheel 1 is detected (S8), then a print wheel with a recess as shown in FIG. 3 has been detected with the first detected blockage of the motor (S5) being caused by the abutment of the blocking lever with one side of the recess. Accordingly, the count in counter 45 of the markings on the rotating print wheel, as detected by scanning device 23 during this clockwise movement; when the zero position is detected represents, an angle $\alpha$ corresponding to the movement. This angle $\alpha$ is recorded as a first identity code $\alpha 1$ and the counter is reset to $\alpha=0°$ at step S20. The next step S21 directs motor 10 to continue rotation to the right until it is blocked again (S22) by the other edge of the recess. In step S23, the number of markings scanned and recorded in the counter when this blockage occurs is recorded as a second identity code $\alpha 2$, whereupon motor 10 is switched off and blocking lever 25 is pivoted out of the blocking position.

With the aid of the two recorded identity codes $\alpha 1$ and $\alpha 2$ (S24), control device 35 obtains from digital memory 36 the identification data required to control print intensity, ribbon advancing step width, and other parameters of the printing device for the newly inserted print wheel.

The blockage of a stepping motor drive, in contrast to a d.c. motor drive with an encoder, can only be detected indirectly by a shift in the zero position of the print wheel. The position of the code recess 17 or 37 of print wheel 1 should therefore by arranged in such a manner that the zero position of print wheel 1, within its possible rotation range, lies between the end positions of the recess.

Figure 6:
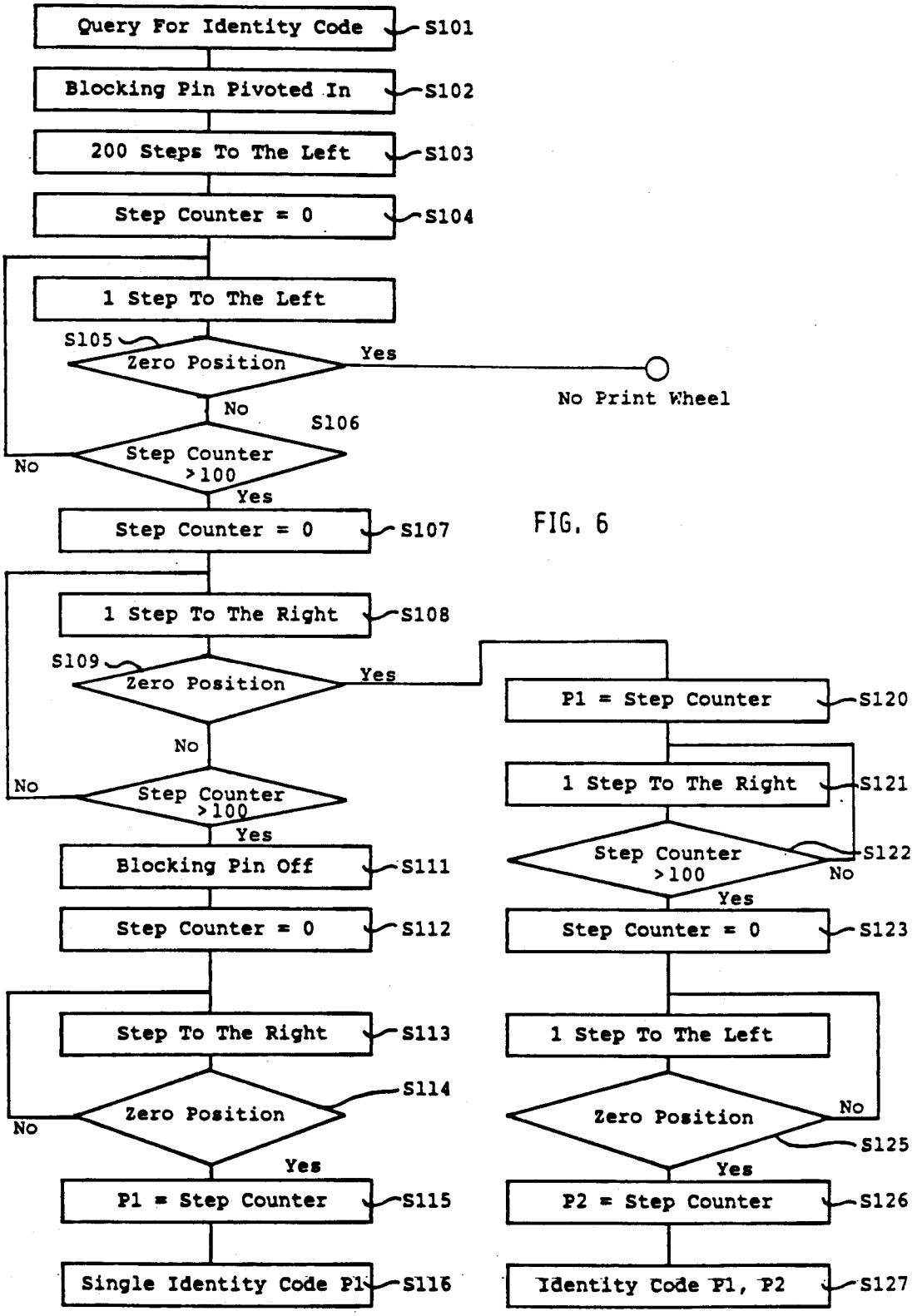
FIG. 6 is a flow chart similar to FIG. 5 for identifying a print wheel according to the invention drive by a stepping motor.

An exemplary sequence of steps to determine an identity code in connection with a stepping motor drive is shown in FIG. 6. According to this embodiment, the sequence is initiallized when blocked lever 25 is again initially pivoted into the blocking position (S101). Then stepping motor 10 is then charged to move 200 steps to the left (S102), with it being assumed that the stepping motor performs 100 steps per revolution. Then the step counter serving as a marker is set to 0 (S103) and stepping motor 10 is further charged to rotate to the left one step (S104). If a zero position is noted at this point (S105), this indicates no print wheel is there.

If the zero position query (S105) for a print wheel is answered in the negative, a determination is made whether the number of charged steps indicated in the step counter is greater than 100 (S106). If this determination is answered in the negative, operations S104–S106 are repeated and stepping motor 10 is charged repeatedly for rotation by one step to the left until either the zero position is deleted (S105) or the step counter indicates more than 100 steps have been counted (S106). When the latter occurs, the step counter is reset to zero (S107) and stepping motor 10 is now charged in single steps for movement to the right (S108), with the zero position of a print wheel again being queried after each step by control device 35 (S109). If no such zero position is noted, a determination 15 made whether the step counter has a count greater than 100 steps (S110), and if not operations S108–S110 are repeated and stepping motor 10 continues to be charged to step to the right until it is determined S110 that the step counter indicates more than 100 steps (S110). When that is determined, blocking lever 25 and the blocking pin are pivoted away (S111) and the step counter is set back to zero (S112). In the next sequence of operations S113–S114, stepping motor 10 is rotated or stepped to the right until the zero position of a print wheel is reached. When the zero position is determined, the count in the step counter is recorded as value P1 (S115) which is fed to the control circuit 35 as a single identity code P1 (S116).

If, after beginning of the charging of the stepping motor 10 to the right in steps (S108), the zero position of print wheel is detected (S109), stepping motor 10 is stopped for a determination of the count in the step counter (S120) which is then used as the first identity code P1. Thereafter, stepping motor 10 is rotated further to the right in single steps (S121) until the step counter indicates greater than 100 steps have been counted (S122). Then, the step counter is set back to zero (S123) followed by stepping motor 10 being rotated stepwise to the left (S124) until the zero position is detected (S125), at which time rotation is terminated.

The count in the step counter at that time furnishes a further identity code P2 (S126).

Identity codes P1 and P2 enable control circuit 35 to again read out the identifying data for each inserted print wheel from digital memory 36 as illustrated (S127).

An example for a typical prior art sensor, which is of conventional construction, for reading codes on the print wheel are disclosed in the U.S. Pat. Nos. 4,293,233 and 4,074,798. This sensing apparatus or scanning device 23 consists of a photocell detector unit and a sensor receiver unit reading marks on the clocking disc and delivering signals to sensor receiver unit in a known manner.

While the invention has been described with reference to preferred specific embodiments, it will be understood that the description is intended to illustrate and not limit the scope of the invention, which is defined by the followng claims.

We claim:

1. A method of automatically identifying a print wheel in a printing mechanism of a typewriter-like machine wherein, the print wheel includes a hub having a centrally disposed bearing bore, a plurality of spokes extending from the hub, type faces disposed on the outer ends of the spokes which can be charged with axial pressure for printing, and a stopping element and one coupling member of a pin/slot connector disposed on the hub of the print wheel; wherein the print wheel is disposed in a print wheel receptacle of the machine, with the print wheel receptacle being driven by a drive motor and coupled to the print wheel during operation by the other member of the pin/slot connection to fix a defined angle between the drive motor and the print wheel; wherein the machine is provided with a blocking member which cooperate with the stopping element disposed on the hub to stop rotation of the print wheel during a rotary search movement to cause engagement of the pin/slot connection and blockage of the drive motor; and wherein scanning means are provided to produce control signals indicating a zero position of the print wheel, the method comprising the step of:

providing a print wheel having the stopping element and the coupling member on the hub readially spaced from one another and forming angle therebetween, with the size of the formed angle uniquely indentifying the set of type faces provided on the spokes;

inserting the print wheel in the receptacle and rotating the print wheel in a first direction with the blocking member in a position to engage the stopping element on the hub of the print wheel to cause engagement of the pin/slot connection;

detecting blockage of the drive motor;

rotating the print wheel in the direction opposite the first direction after detection of drive motor blockage;

determining the size of said angle by counting the number of steps of movement of the print wheel until the zero position of the print wheel is reached; and using the determined size of the angle to produce identification data for the print wheel which are stored as digital signals in a digital memory, to enable the sequence of printer functions of the printing mechanism to be controlled automatically for the particular set of print type faces of the identified print wheel.

2. A method as defined in claim 1, wherein the stopping element comprises a detent recess disposed on the hub and the blocking member has a blocking tab at its free end; and further comprising the steps of moving the blocking tab into a blocking position against the print wheel hub to enable the blocking tab to engage with the detent in a form-locking manner prior to said step of rotating the print wheel in a first direction, and moving the blocking tab out of engagment with the detent recess prior to said step of rotating the print wheel in the opposite direction.

3. A method as defined in claim 1, wherein the stopping element comprises a recess having two side edges formed radially to the bearing bore and which serve as abutments for the blocking member, with the recess in the hub being arranged such that the zero position of the print wheel lies between the two side edges; and wherein, after determining the angle between one of the abutments and the zero position of the print wheel, continuing said step of rotating the print wheel in the opposite direction and determining the size of the angle between the zero position and the other abutment to provide further identifying data.

4. A method as defined in claim 1, wherein the blocking member comprises a blocking lever pivotal about an axis; and further comprising pivoting the lever by means of a drive member from a rest position into the blocking position against the force of a reset spring in order to block the print wheel prior to said step of rotating the print wheel in a first direction.

5. A method as defined in claim 1, wherein the pin/slot connection includes a pin which is diposed on, and spring-tensioned in the axial direction, of the print wheel receptacle and a slot disposed on the hub of the print wheel, and the step of rotating the print wheel in a first direction includes engaging the pin on the receptacle in the slot on the print wheel hub in a form-locking manner to prevent further relative rotation between the receptacle and the print wheel.

6. A method as defined in claim 5, wherein the slot on the print wheel is an elongated radially extending hole.

7. A method as defined in claim 5, wherein the slot is arranged in symmetry with a geometric radial line for the zero position of the print wheel.

8. In a print wheel for a printing mechanism of a typewriter or office machine of similar construction in which type faces are printed by axial pressure, with the print wheel comprising a hub having a centrally disposed bearing bore, and a plurality of spokes extending radially from the hub with each spoke carrying a type face at its outer end, and wherein the hub is provided with one element of a pin/slot connection for coupling the hub in a form-locking manner with a print wheel receptacle, which is driven by a drive motor, of a print mechanism for fixing a defined angle between the drive motor and a zero position of the print wheel, and with at least one identifying feature which can be detected by the printing mechanism to identify the set of type faces on the print wheel to enable control of the printing mechanism according to the identified set of type faces;

the improvement wherein: an abutment is disposed on said hub for engaging a selectively moveable blocking member disposed on the printing mechanism to stop rotation of the print wheel during an initial rotary search movement in a printing mechanism to enable engagement of the pin/slot connection; and said abutment forms an angle in a direction of rotation with the zero position of said print wheel with said angle constituting said identifying feature and being different for each set of type faces.

9. A print wheel as defined in claim 8 wherein said one element of said pin/slot connection is located at said zero position of said print wheel.

10. A print wheel as defined in claim 9, wherein said hub of said print wheel has two of said abutments for the blocking member which are disposed on the hub at opposite sides relative to said one element and, in order to identify different print wheels, having differing angles relative to the coupling element in the direction of rotation.

11. A print wheel as defined in cliam 10, wherein said hub includes a recess which is disposed concentrically with said bearing bore and has side edges oriented radially relative to said bearing bore and forming said two abutments for the blocking member, and said recess is arranged such that said zero position of said print wheel lies between said side edges of said recess within its possible rotation range.

12. A print wheel as defined in claim 9, wherein said abutment is a detent recess and the blocking member has a blocking tab at its free end, the blocking tab engaging the detent recess in a form-locking manner to stop the rotation of the print wheel.

* * * * *